US010082047B2

(12) United States Patent
Joshi et al.

(10) Patent No.: US 10,082,047 B2
(45) Date of Patent: Sep. 25, 2018

(54) RAPID WARM-UP SCHEMES OF ENGINE AND ENGINE COOLANT FOR HIGHER FUEL EFFICIENCY

(71) Applicant: Toyota Motor Engineering & Manufacturing North America, Inc., Erlanger, KY (US)

(72) Inventors: Shailesh N. Joshi, Ann Arbor, MI (US); Ercan Mehmet Dede, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 120 days.

(21) Appl. No.: 14/979,461

(22) Filed: Dec. 27, 2015

(65) Prior Publication Data

US 2017/0183979 A1 Jun. 29, 2017

(51) Int. Cl.

| | |
|---|---|
| ***F02N 19/10*** | (2010.01) |
| ***F01K 23/04*** | (2006.01) |
| ***F01P 3/02*** | (2006.01) |
| *F02N 19/02* | (2010.01) |

(52) U.S. Cl.

CPC ..... *F01K 23/04* (2013.01); *F01P 3/02* (2013.01); *F01P 2003/021* (2013.01); *F01P 2060/18* (2013.01); *F02N 19/02* (2013.01); *F02N 19/10* (2013.01)

(58) Field of Classification Search

CPC ..... F02N 19/10; F02N 19/02
USPC ..... 123/142.5 R
See application file for complete search history.

(56) References Cited

U.S. PATENT DOCUMENTS

| | | | | |
|---|---|---|---|---|
| 3,963,012 | A | 6/1976 | Harned | |
| 2004/0050052 | A1* | 3/2004 | Niikura | F01K 23/065 60/670 |
| 2006/0144047 | A1* | 7/2006 | Inaba | F02N 19/10 60/618 |

(Continued)

OTHER PUBLICATIONS

Obieglo et al., "Future EfficientDynamics with Heat Recovery.", DEER 2009—High Efficiency Engine Technologies., BMW Group Research and Technology, 2009, pp. 1-30, (30 pages).

(Continued)

*Primary Examiner* — Jacob Amick
*Assistant Examiner* — Charles Brauch
(74) *Attorney, Agent, or Firm* — Christopher D. Darrow; Darrow Mustafa PC

(57) ABSTRACT

A system for rapidly heating a vehicle engine when the engine is below a pre-determined temperature allows for improved fuel efficiency after a vehicle cold-start. The system includes an organic Rankine cycle (ORC) loop having a two-phase ORC fluid traveling circuitously through a conduit. The ORC fluid is vaporized by a power electronics cooling device and by an evaporator in thermal communication with exhaust waste heat. The vaporized ORC fluid is passed through an expander to generate electrical power. When the vehicle engine is below the pre-determined temperature, heat from the vaporized ORC fluid is transferred directly or indirectly to the engine. When the vehicle engine is at or above the pre-determined temperature, heat from the vaporized ORC fluid is instead transferred to an alternate heat sink.

11 Claims, 4 Drawing Sheets

(56) References Cited

U.S. PATENT DOCUMENTS

2010/0018207 A1* 1/2010 Juchymenko ..... F01K 23/065
60/670
2014/0346809 A1* 11/2014 Lee ..... B60K 11/085
296/180.5

OTHER PUBLICATIONS

Sprouse III et al., "Review of organic Rankine cycles for internal combustion engine exhaust waste heat recovery", Applied Thermal Engineering, Elsevier, 2013, pp. 711-722, (12 pages).
Roberts et al., "Internal combustion engine cold-start efficiency: A review of the problem, causes and potential solutions", Energy Conversion and Management, Elsevier, 2014, pp. 327-350, (24 pages).
Pang et al., "A review on air flow and coolant flow circuit in vehicles; cooling system", International Journal of Heat and Mass Transfer, Elsevier, 2012, pp. 6295-6306, (12 pages).
Shin et al., "Use of electromagnetic clutch water pumps in vehicle engine cooling systems to reduce fuel consumption", Energy, Elsevier, 2013, pp. 624-631, (8 pages).
Boretti, "Energy Recovery in Passenger Cars", Department of Mechanical and Aerospace Engineering, Missouri University of Science and Technology, Rolla, MO 65409, Jun. 2012, vol. 134, (8 pages).
Moreno, "Two-Phase Cooling Technology for Power Electronics with Novel Coolants", 2011 DOE Vehicle Technologies Program Review Presentation, National Renewable Energy Laboratory, May 10, 2011, (22 pages).

* cited by examiner

RAPID WARM-UP SCHEMES OF ENGINE AND ENGINE COOLANT FOR HIGHER FUEL EFFICIENCY

TECHNICAL FIELD

The present disclosure generally relates to systems for rapidly warming a vehicle engine after a cold start, and more particularly, to systems that capture and utilize waste heat to achieve rapid heating of an engine to quickly reach an efficient operating temperature.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

The engine cooling system of a typical internal combustion engine pumps coolant through the engine body and head where it picks up the heat and eventually rejects the heat via the radiation mounted on the front of the car. A thermostat controls the temperature of the coolant for safe operation.

During engine operation, typically 53% of combustion energy is transferred as heat to the cylinder walls. The energy transferred to the cylinder walls causes the coolant, the metallic structure (including the block and crankshaft) and the lubricant to warm up. However, less than half of this heat is found to warm-up any of the ancillary circuits (such as the lubricant or coolant), while the majority is instead lost directly to the environment (termed 'unused heat').

It is widely recognized among car manufacturers that a 100 second quicker warm-up produces a reduction of 1% in fuel consumption and, consequently, in $CO_2$ emission for a small-medium weight car. Additionally, at sub-zero temperatures the heat loss from the engine walls is quite significant, resulting in an even greater compromise of fuel efficiency under these conditions. Thus, if a greater proportion of unused heat could be captured and directed toward engine heating, fuel efficiency would improve and $CO_2$ emission would decrease after a cold start.

SUMMARY

This section provides a general summary of the disclosure, and is not a comprehensive disclosure of its full scope or all of its features.

In various aspects, the present teachings provide a system for rapidly heating a vehicle engine. The system includes an engine block and an organic Rankine cycle (ORC) loop. The ORC loop includes an ORC fluid conduit configured to direct an ORC fluid throughout the ORC loop. The ORC loop is configured to direct vaporized ORC fluid through the engine block when the engine is operating below a pre-determined temperature and to direct condensed ORC fluid through the engine block when the engine is operating at or above the pre-determined temperature. The system can further include a power electronics cooler and/or an evaporator to vaporize the ORC fluid. The system can also include an expander configured to decrease pressure of vaporized ORC fluid, the expander being in mechanical communication with an electric generator.

In other aspects, the present teachings provide a system for rapidly heating a vehicle engine. The system includes an organic Rankine cycle (ORC) loop having an ORC fluid conduit to direct an ORC fluid through the ORC loop. The system can also include an engine loop in thermal communication with the ORC loop. The engine loop is configured to direct an engine coolant through the engine loop, including the engine. The engine loop further is configured to direct engine coolant heated, directly or indirectly by the ORC loop, through the engine only when the engine is operating below a pre-determined temperature.

In still other aspects, the present teachings provide a system for rapidly heating a vehicle engine. The system can include an Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

Systems of the present disclosure can utilize multiple varieties of waste heat in an organic Rankine cycle (ORC) to generate electric power and to rapidly warm a cold-running engine to maximize fuel efficiency. Heat flow is then directed away from the engine once the engine has reached an optimal operating temperature. Thus, systems of the present disclosure can improve fuel efficiency, and may be particularly useful for vehicles operated in relatively cold climates.

Systems of the present disclosure generally include a two-phase (vapor/liquid) coolant stream, having an evaporator to vaporize liquid coolant using waste heat obtained from engine exhaust and/or from power electronics. The vaporized coolant can be directed toward an expander linked to an electric generator, to produce electric energy using organic Rankine cycle (ORC). A disclosed system will generally include an engine heating loop equipped with a bypass loop and configured with valves so that coolant vapor is placed in thermal contact with the engine after a cold start so that the engine is rapidly warmed. Once the engine achieves a pre-determined temperature, the valves are configured to direct coolant vapor through the bypass loop so that the coolant vapor is no longer in thermal contact with the engine.

Figure 1:
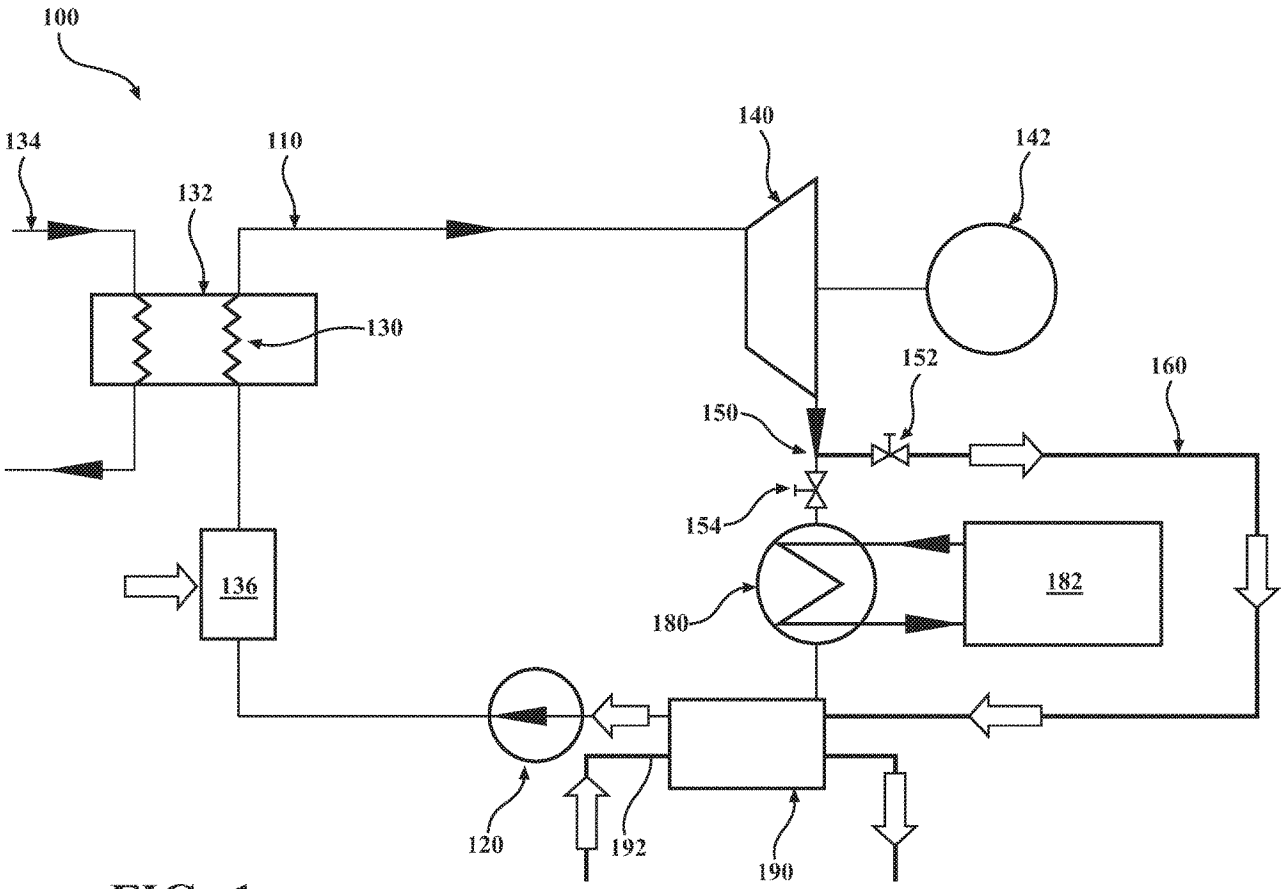
FIG. 1 is a schematic diagram of a system for two-phase cooling and heating of an engine using vapor and energy recovery using organic Rankine cycle.

FIG. 1 shows an example system 100 of the present disclosure. The system 100 includes a ORC fluid conduit 110 that directs a coolant throughout the system. The coolant will typically be a two-phase coolant that will be liquid or vapor at various positions within the ORC fluid conduit 110. In the example of FIG. 1, coolant is made to flow through the ORC fluid conduit 110 by at least one pump 120. The direction of flow of the coolant through the system 100 is shown by inline arrows.

The ORC fluid conduit 110 has an exhaust heat transfer site 132 configured to transfer waste heat that has been captured from engine exhaust into the coolant, thereby assisting in vaporization of the coolant. In the example of FIG. 1, the exhaust heat transfer site 132 includes a first evaporator 130 in thermal contact with an exhaust heat line 134. As shown in FIG. 1, the coolant transfer line can also pass through a power electronics (PE) cooler 136, a device configured to capture and transfer heat from one or more power electronics instruments, such as SC-to-DC converter, phase converter, and the like. In the example of FIG. 1, the ORC fluid conduit 110 passes through the PE cooler 136, partially vaporizing the coolant. The remainder of unvaporized coolant is vaporized as it subsequently passes through the exhaust heat transfer site 132, having an evaporator 130 coupled to an exhaust heat line 134. Thus, at position 1, the coolant is present in the ORC fluid conduit 110 as a high pressure vapor.

The system 100 can additionally include an expander 140, such as a turbine. In the example of FIG. 1, the turbine 141, located downstream of the evaporator 130, is turned by expansion of the vaporized coolant. Turning of the turbine 141 activates an electrical generator 142, thus producing electrical energy. Downstream of the expander 140 is located a branch point 150, controlled by first valve 152 and second valve 154. After a cold-start, or at another time when the engine is operating below a pre-determined temperature, the first valve 152 is open and the second valve 154 is closed. This sends the vaporized coolant through engine heating loop 160, which in turn directs high enthalpy, vaporized coolant to the vehicle engine 190. The vaporized coolant is in thermal contact with the engine, transferring heat to the engine and becoming condensed in the process. Thus, the state in which first valve 152 is open and second valve 154 is closed can be regarded as an engine warming state.

Once the engine has reached the pre-determined temperature, second valve 154 opens and first valve 152 closes, sending the vaporized coolant through a condenser 180, which cools and condenses the coolant before the coolant reaches the engine 190 so that the coolant does not transfer heat to the engine. The condenser 180 can be in fluid communication with a heat sink 182 such as an air cooled conditioner. Thus, the state in which first valve 152 is closed and second valve 154 is open can be regarded as a non-engine warming state.

Figure 2:
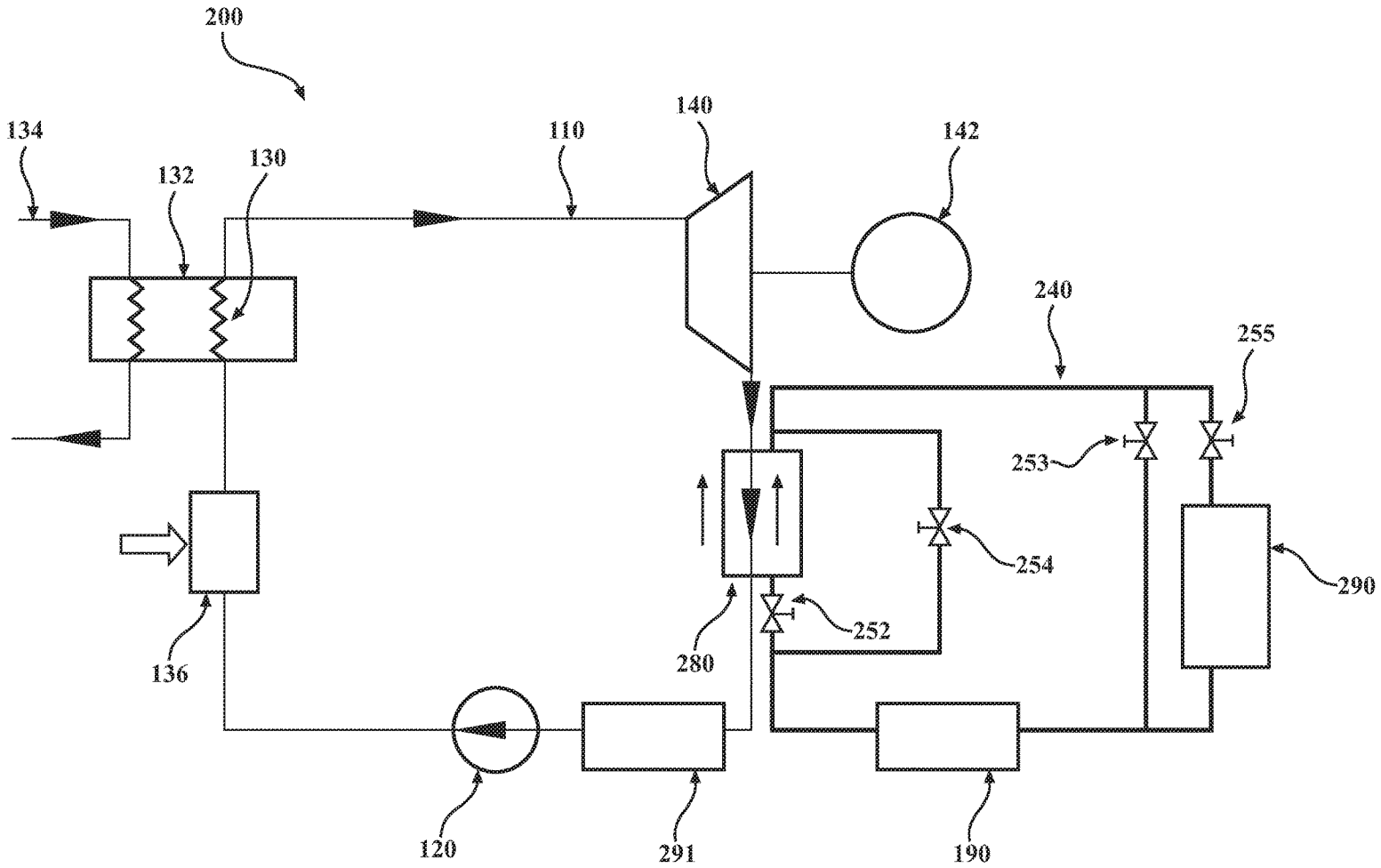
FIG. 2 is a schematic diagram of a system for coolant warm-up using organic Rankine cycle and condenser waste heat.

In the example of FIG. 2, the two alternate condensers positioned in-line with the ORC fluid conduit 110 of FIG. 1 (i.e. condenser 180 and engine 190, operable to function as a condenser when the system 100 is in an engine warming state) are replaced with a single heat exchanger 280 that is alternatively activated and deactivated. Referring now to FIG. 2, the system 200 has the ORC fluid conduit 110 with evaporator 130, expander 140, and heat exchanger 280. After low-pressure vaporized coolant leaves the expander 140, it passes through the heat exchanger 280. If the engine 190 is operating below a pre-determined temperature, then the system 200 is in an engine warming state in which the valves 252 and 253 are open and the valves 254 and 255 are closed. In this configuration, a fluid circulating in the engine loop 240 is heated at the heat exchanger 280 and the heated fluid is directed to the engine 190, causing the engine to be warmed. Once the engine 190 is determined to have reached the predetermined temperature, the system 200 is switched to a non-engine warming state, with valves 252 and 253 closed and valves 254 and 255 open. In this configuration, fluid circulating in the engine loop 240 bypasses the heat exchanger 280 and is directed to heat sink 290 prior to coming into thermal contact with the engine 190. As such, no heat from the loop composed of the ORC fluid conduit 110 is transferred to the engine. Note that the system 200 includes a condenser 291, which can be any type of condenser or heat sink, to re-condense vaporized ORC fluid when the system 200 is not in an engine warming state. This may be necessary because, when valves 252 and 253 are open and valves 254 and 255 are closed, ORC fluid will not be condensed at the heat exchanger 280.

Figure 3:
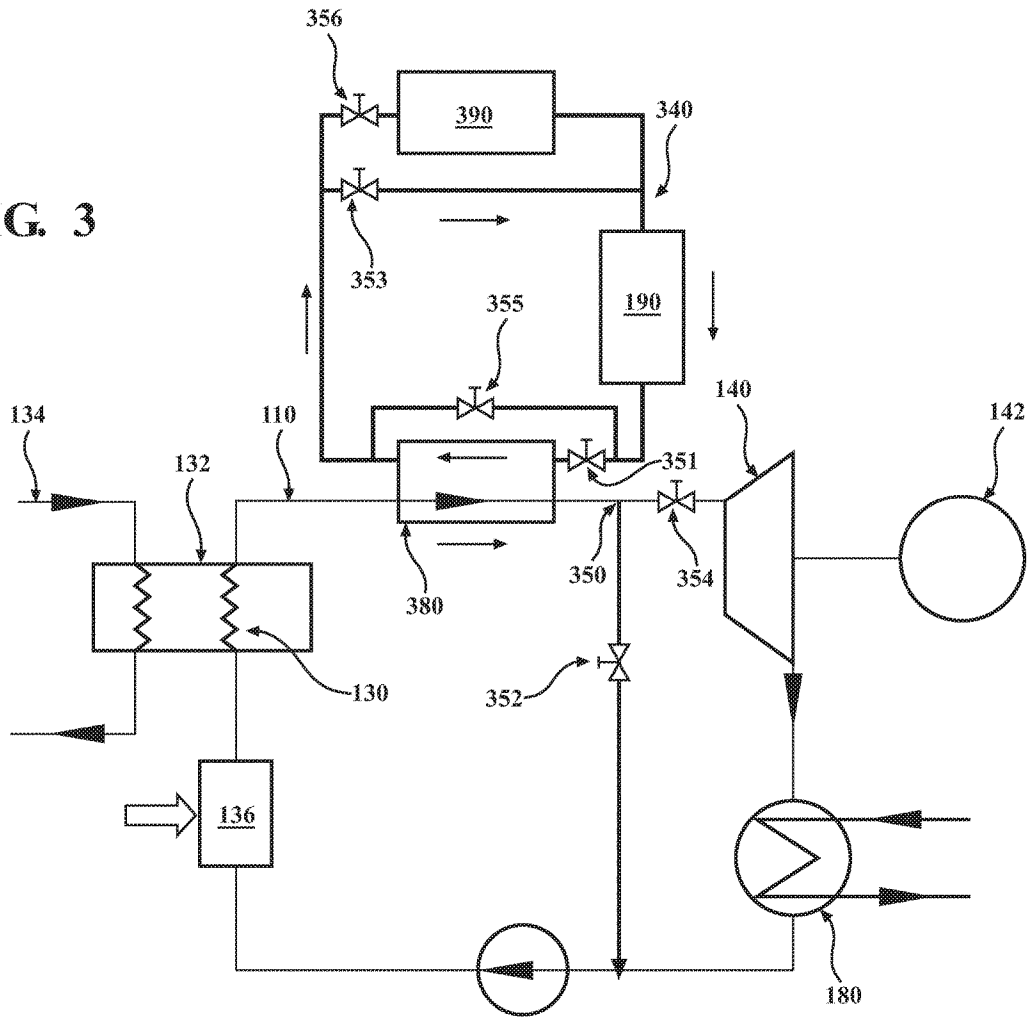
FIG. 3 is a schematic diagram of a system for coolant warm-up post waste heat source.

FIG. 3 shows yet another example in which ORC only operates when the system 300 is in non-engine warming mode. The example of FIG. 3 has an ORC loop with an evaporator 130 receiving waste heat from the exhaust heat line 134 via heat exchanger 132. The evaporator 130 is optionally augmented by heat from PE cooling device 136. Similarly, as in the examples of FIGS. 1 and 2, the example of FIG. 3 has an expander 140 downstream of the evaporator 130, the expander in mechanical communication with an electric generator 142, and a condenser 180 downstream of the expander 140. In the example of FIG. 3, a heat exchanger 380 is positioned between the evaporator 130 and the expander 140, and branch point 350 is present between the heat exchanger 380 and the expander 140.

When the engine 190 is determined to be in a sub-optimal temperature, the system 300 is present in an engine warming state with valves 351, 352, and 353 open and valves 354, 355, and 356 closed. In this configuration, heat from the vaporized ORC fluid is transferred to the coolant of the engine loop 340 and the expander 140 and condenser 180 of the ORC loop are bypassed. Heated engine coolant is directed from the heat exchanger 380 to the engine 190 without passing by heat sink 390. Thus heat is transferred from the ORC fluid to the engine 190.

When the engine reaches the pre-determined temperature, the system 300 switches to a non-engine warming state, with valves 351, 352, and 353 closed and valves 354, 355, and 356 open. In this configuration, coolant in the engine loop 340 bypasses the heat exchanger 380 so that heat is not transferred from the ORC fluid to the engine coolant. Instead, the high-pressure vaporized ORC fluid is directed through the expander 140, turning the generator 142 to generate electric power. The low pressure vaporized ORC fluid is then condensed at the condenser 180.

Figure 4:
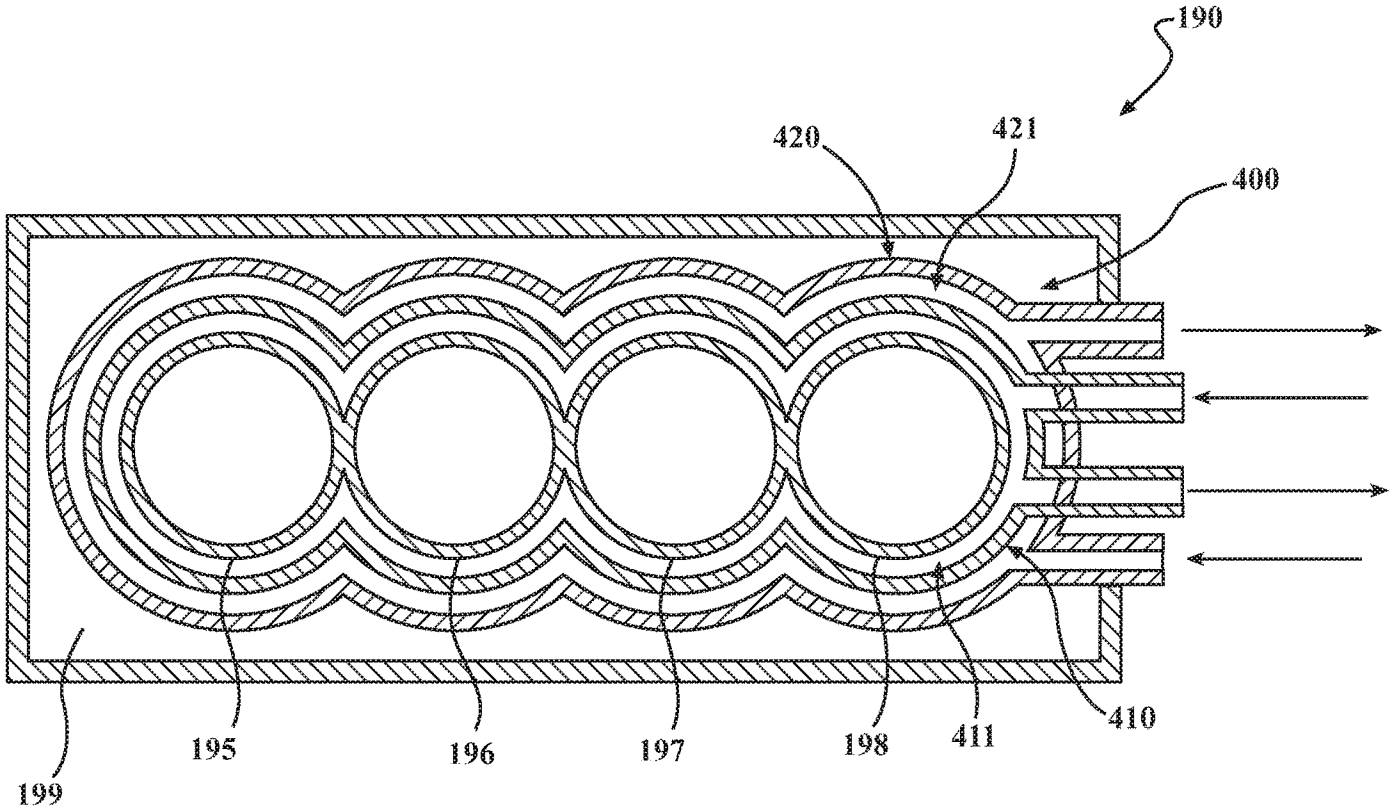
FIG. 4 is a schematic diagram of an engine having a dual layered jacket for controlling engine temperature.

With reference now to FIG. 4, various implementations of the present system 100 can optionally include a dual-layer jacket 400 in the engine 190 to take advantage of the poor thermal conductivity of coolant vapor. The example the engine block 199 of engine 190 of FIG. 4 includes four cylinders 195, 196, 197, and 198. The dual layer jacket 400 includes a first jacket 410 defining a first chamber 411 that is in direct thermal communication with the four cylinders 195-198. The first chamber 411 is in fluid communication with an engine coolant loop, such as engine coolant loop 192 of FIG. 1. The dual-layer jacket 400 can additionally include a second jacket 420 that defines a second chamber 421 in direct thermal communication with the first chamber 411. The second chamber 421 can additionally be in fluid communication with the ORC fluid conduit 110. Thus when the system 100 is in an engine warming state such that vaporized ORC fluid is directed to the engine 190, the second chamber 421 is filled with vaporized ORC fluid forming an insulative layer between engine coolant in the first chamber 411 and the engine block 199. This inhibits transfer of heat from the cylinders 195-198 to the engine block 199, thus increasing the rate of temperature increase of the cylinder 195-198. When the system 100 switches to a non-engine warming state, the second chamber 421 is filled with liquid ORC fluid, enabling more efficient heat transfer from engine coolant in the first chamber 411 to the engine block 199, so that the cylinders 195-198 do not continue to increase in temperature.

Also disclosed is a method for rapidly heating a vehicle engine after engine startup. The method includes a step of passing a vaporized fluid in direct thermal communication with the engine block immediately upon startup to transfer heat directly from the vaporized fluid to the engine. In some implementations, the vaporized fluid can be an ORC fluid that is part of an ORC loop as described above. The method can include an additional step of monitoring the engine temperature to determine whether the engine has reached a pre-determined temperature. The method can include an additional step of condensing the vaporized fluid, once the engine has reached the pre-determined temperature, so that condensed fluid is passed through the engine block.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A system for rapidly heating a vehicle engine, the system comprising:

an engine block;

an evaporator;

an expander;

a condenser;

a heat sink in fluid communication with the condenser;

an organic Rankine cycle (ORC) loop comprising:

an ORC fluid conduit in direct thermal communication with the evaporator, the expander, the condenser, and the engine block, the ORC fluid conduit being configured to direct an ORC fluid through a circuit, the ORC loop being configured to selectively:

direct ORC fluid from the evaporator and through the expander to create a vaporized ORC fluid, the vaporized ORC fluid being directed through the engine block when the engine is operating below a pre-determined temperature; and direct ORC fluid from the evaporator and through the expander to create a vaporized ORC fluid, the vaporized ORC fluid being directed through the condenser and the heat sink, configured to remove heat from low pressure vaporized ORC fluid to create a condensed ORC fluid, the condensed ORC fluid being directed through the engine block when the engine is operating at or above the pre-determined temperature; and a power electronics cooler in thermal communication with the ORC fluid circuit to at least partially vaporize the ORC fluid.

2. The system as recited in claim 1, wherein the expander is in mechanical communication with an electric generator configured to produce electrical power.

3. The system as recited in claim 1, wherein the ORC loop further comprises a plurality of valves configured to selectively direct low pressure vaporized ORC fluid to:

a first valve in fluid communication with the engine when the engine is below the pre-determined temperature; and a second valve in fluid communication with a heat sink, prior to the engine, when the engine is at or above the pre-determined temperature.

4. The system as recited in claim 1, wherein the engine block comprises a dual layered jacket defining a first chamber in thermal communication with engine cylinders and in fluid communication with an engine coolant loop, the first chamber configured to absorb heat from the engine cylinders.

5. The system as recited in claim 4, wherein the dual layered jacket further defines a second chamber in thermal contact with the first chamber and in fluid communication with the ORC fluid conduit, the second chamber selectively forming an insulative layer when filled with vaporized ORC fluid and forming a conductive layer when filled with liquid ORC fluid.

6. A system for rapidly heating a vehicle engine, the system comprising:

an engine block;

an organic Rankine cycle (ORC) loop having an ORC fluid conduit to direct an ORC fluid through a circuit in direct thermal communication with the engine block;

an evaporator to vaporize the ORC fluid;

an expander configured to decrease a pressure of vaporized ORC fluid;

a heat exchanger;

a condenser in fluid communication with the ORC fluid circuit;

an engine coolant loop in thermal communication with the heat exchanger to transfer heat from ORC fluid in the ORC loop to coolant circulating in the engine coolant loop;

a power electronics cooler in thermal communication with the ORC fluid circuit to at least partially vaporize the ORC fluid; and a heat sink in selective thermal communication with the engine coolant loop;

wherein the engine coolant loop is configured to direct an engine coolant through the circuit that includes the engine block, the engine coolant loop further comprising a first valve configured to direct heated engine coolant through the engine only when the engine is operating below a pre-determined temperature, and a second valve configured to selectively direct heated coolant to the heat sink when the engine is operating at or above the pre-determined temperature.

7. The system as recited in claim 6, wherein the expander is in mechanical communication with an electric generator.

8. The system as recited in claim 6, wherein the heat exchanger is positioned within the ORC loop downstream of the expander.

9. The system as recited in claim 6, wherein the heat exchanger is positioned within the ORC loop upstream of the expander.

10. The system as recited in claim 9, wherein the ORC loop further comprises a plurality of valves configured to selectively direct ORC fluid through:

the expander when the engine is at or above the pre-determined temperature; and an expander bypass loop when the engine is below the pre-determined temperature.

11. A system for rapidly heating a vehicle engine, the system comprising:

an engine block;

an organic Rankine cycle (ORC) loop comprising:

an ORC fluid conduit to direct an ORC fluid through a circuit that is in direct thermal communication with the engine block;

a power electronics cooler in thermal communication with the circuit to at least partially vaporize the ORC fluid;

an expander configured to decrease a pressure of the vaporized ORC fluid, the expander being in mechanical communication with an electric generator;

a first plurality of valves configured to direct ORC fluid through the expander when the engine is at or above a pre-determined temperature, and to direct the ORC fluid through an expander bypass loop when the engine is below the pre-determined temperature;

a heat exchanger configured to transfer heat from the vaporized ORC fluid in the ORC loop to coolant circulating in an engine coolant loop, the engine coolant loop in fluid communication with:

the engine block;

a heat sink; and a second plurality of valves configured to selectively direct heated coolant to the engine when the engine is below a pre-determined temperature, and to the heat sink when the engine is at or above the pre-determined temperature;

wherein the engine block comprises a dual layered jacket defining:

a first chamber in thermal communication with engine cylinders and in fluid communication with the engine coolant loop, the first chamber configured to absorb heat from engine cylinders; and a second chamber in thermal communication the first chamber and in fluid communication with the ORC fluid conduit, the second chamber forming an insulative layer when filled with vaporized ORC fluid, and forming a conductive layer when filled with liquid ORC fluid.

* * * * *